US007784399B2

(12) United States Patent
Sasine et al.

(10) Patent No.: US 7,784,399 B2
(45) Date of Patent: Aug. 31, 2010

(54) METHOD AND PROCESS OF COLLECTING, PACKAGING AND PROCESSING RECYCLABLE WASTE

(75) Inventors: John Sasine, South Jordan, UT (US); Charles Jongert, Sandy, UT (US); Marvin Acey, South Jordan, UT (US); Jeffery A. Ashby, Taylorsville, UT (US)

(73) Assignee: Paper and Plastic Partnership, LLC, Salt Lake City, UT (US)

( * ) Notice: Subject to any disclaimer, the term of this patent is extended or adjusted under 35 U.S.C. 154(b) by 787 days.

(21) Appl. No.: 11/482,356

(22) Filed: Jul. 7, 2006

(65) Prior Publication Data

US 2007/0020410 A1 Jan. 25, 2007

Related U.S. Application Data

(63) Continuation-in-part of application No. 11/299,442, filed on Dec. 12, 2005, now abandoned, which is a continuation of application No. 11/166,516, filed on Jun. 24, 2005, now abandoned.

(60) Provisional application No. 60/617,971, filed on Oct. 11, 2004.

(51) Int. Cl.
*B65B 13/02* (2006.01)

(52) U.S. Cl. ..... 100/3; 428/2

(58) Field of Classification Search ..... 100/3, 100/35; 428/2; 206/83.5, 449, 451, 593
See application file for complete search history.

(56) References Cited

U.S. PATENT DOCUMENTS 4,382,108 A 5/1983 Carroll et al.
4,993,563 A 2/1991 Bolling et al.
5,129,329 A * 7/1992 Clasen ..... 108/51.3
5,131,210 A 7/1992 Kiya
5,239,919 A 8/1993 Maki et al.
5,392,912 A * 2/1995 Grubbs ..... 206/451
6,131,376 A 10/2000 Grey et al.
6,274,637 B1 8/2001 Schallenberg et al.
6,821,595 B2 11/2004 Murcia et al.
7,412,397 B2 8/2008 Grenchus
7,413,602 B2 8/2008 Grasso (Continued)

FOREIGN PATENT DOCUMENTS

SE 502785 1/1996

OTHER PUBLICATIONS

U.S. Appl. No. 11/299,442, filed May 20, 2009, Office Action.

(Continued)

*Primary Examiner*—Jimmy T Nguyen
(74) *Attorney, Agent, or Firm*—Workman Nydegger

(57) ABSTRACT

Recyclable waste byproducts are efficiently collected for recycling at stores or other locations by compacting the recyclable waste as layers in a composite bale with cardboard. The composite bales can be formed using existing cardboard balers that retailers or other stores typically already have for baling recyclable cardboard. In one embodiment, the composite bales are preferably formed with a bottom layer of cardboard, a middle layer of one or more types of recyclable waste byproducts, and a top layer of cardboard. The layered structure can be modified to omit one of the cardboard layers or to add additional waste byproduct or cardboard layers.

13 Claims, 9 Drawing Sheets

U.S. PATENT DOCUMENTS

| | | | | |
|---|---|---|---|---|
| 7,416,142 | B2 | 8/2008 | Baker | |
| 7,416,462 | B2 | 8/2008 | Noma | |
| 7,416,612 | B1 | 8/2008 | Montie | |
| 7,416,641 | B2 | 8/2008 | Denisson | |
| 7,419,058 | B2 | 9/2008 | Wening | |
| 2003/0010669 | A1 * | 1/2003 | Simhaee | 206/554 |
| 2008/0217811 | A1 | 9/2008 | Wolf | |
| 2008/0221228 | A1 | 9/2008 | Notari | |
| 2009/0029074 | A1 | 1/2009 | Sasine | |
| 2009/0148629 | A1 | 6/2009 | Sasine | |
| 2010/0095855 | A1 | 4/2010 | Sasine | |

OTHER PUBLICATIONS

U.S. Appl. No. 12/245,239, filed May 20, 2009, Office Action.
U.S. Appl. No. 12/245,239 filed Nov. 24, 2009, Office Action.

* cited by examiner

METHOD AND PROCESS OF COLLECTING, PACKAGING AND PROCESSING RECYCLABLE WASTE

CROSS REFERENCE TO RELATED APPLICATIONS

This application is a continuation-in-part of U.S. Utility application Ser. No. 11/299,442, now abandoned, entitled "METHOD AND PROCESS OF COLLECTING AND PROCESSING RECYCLABLE WASTE," filed on Dec. 12, 2005, which is a continuation of U.S. Utility application Ser. No. 11/166,516, now abandoned, entitled: "METHOD AND PROCESS OF COLLECTING AND PROCESSING RECYCLABLE WASTE," filed on Jun. 24, 2005, and which claims the benefit of U.S. Provisional Application No. 60/617,971, filed Oct. 11, 2004, each of which are incorporated herein by reference. This application also claims the benefit of U.S. Provisional Application No. 60/617,971, filed Oct. 11, 2004, which is incorporated herein by reference.

BACKGROUND OF THE INVENTION

1. The Field of the Invention

The present invention relates to the field of recycling. More particularly, the present invention relates to methods of collecting and processing recyclable waste byproducts through the formation of bales including both cardboard and other recyclable waste.

2. The Relevant Technology

As the consuming public demands increased convenience when shopping for products and services, retail and wholesale distribution centers are following the "super-center" trend and carrying not only greater quantities and varieties of products, but are also offering services which have previously required consumers to visit a separate store. With the increased quantity and variety of products and services, the amount of waste generated at such retail and wholesale centers has also increased. As a result, recycling is increasingly important to control the costs associated with this increased amount of waste.

By way of example, retail and wholesale centers are now common which merge the traditional department stores carrying clothing with a grocery store. As a result, customers can visit a single store to obtain most of the items the customer may need, whether it be grocery or clothing. Moreover, many of these stores offer an even greater one-stop-shopping experience by combining even more types of products and services into a single establishment.

For instance, a single store may now offer not only clothing and grocery items, but also furniture, electronics, office supplies, automobile parts, sporting goods, and the like. Some retail and wholesale distribution centers have expanded even further and even provide auto servicing centers, business centers, beauty salons, restaurants and vending areas, photography studios, and the like all under the same roof.

Each type of product or service potentially brings with it various types of recyclable and non-recyclable waste which must be dealt with by the retail or wholesale center. For example, the use of plastic wrap and plastic film bags is increasingly permeating more and more aspects of retail sales as well as the shipping and packaging industry. For example, plastic shopping bags are well known to the general public as they are a predominant method for consumers to carry groceries and other purchased goods from a store. An even greater volume of plastic film, however, is generated for product packaging and distribution. For example, palates of goods are frequently wrapped with large sheet of shrink wrap plastic film to keep the contents of the pallet from shifting or falling during transit. Groceries may, for example, by loaded by a distributor onto the pallet and then wrapped with shrink wrap in this manner.

Another example is in clothing distribution in which each garment is typically transported wrapped in its own plastic sleeve and/or included with a plastic clothing hanger used by the retailer to store and display the item. Some estimates are that plastic bags on apparel can account for over sixty percent of plastic waste at retail department stores.

Restaurants and vending areas may also receive food items and food containers which are similarly packaged and wrapped in shrink wrap that must be disposed of by the store. In addition, recyclable products such as aluminum beverage cans or drink bottles made of polyethylene terephthalate (PET) or another plastic may collect in such areas and, if not recycled, are also be discarded by the store. Business centers and auto servicing centers similarly produce still other waste byproducts. For example, an auto servicing center may provide various servicing options such as oil changes and fluid exchange services. As a result, the auto servicing center may produce and discard large numbers of gallon bottles used to store window washing fluid or antifreeze/coolant or quart bottles used to store motor oil. In some cases, such bottles are made of high density polyethylene (HDPE) or another recyclable plastic. Business centers, in which consumers may make photocopies or access computers to print documents or images may also produce large amounts of discarded paper and shredded paper. Such paper, coupled with the paper and shredded office paper produced by the store's managing office, is often a large quantity of recyclable waste.

With this vast amount of plastic and other recyclable waste byproducts used in the packaging and shipping industries, and in the everyday operations of a retail or wholesale distribution center, there is a need to recover this material out of the waste stream in an efficient and effective manner. Stores that aggressively collect and recycle waste byproducts separate from other garbage frequently save hundreds of dollars per month in the cost of trash hauling. Still, the storage, baling, shipping, and processing of plastic and other recyclable waste byproducts is extremely inefficient under current methods.

At stores and distribution centers, for example, one conventional method of collecting plastic waste film for recycling is to stuff the plastic into other large plastic bags and toss them somewhere in the facility in a haphazard fashion (e.g., on top of other bales or bins). For transportation, the bags are thrown into the back of a truck for transportation. Similar methods are often used for collecting other recyclable waste byproducts such as beverage containers, plastic bottles, shredded paper, and plastic hangers. These methods are, however, extremely inefficient uses of space.

Because of these challenges, much of otherwise recyclable waste is disposed of as garbage. Not only does this add to pollution and more quickly fill landfills, but the recyclable waste byproducts fill on-site trash receptacles very quickly. Because waste is typically paid for by volume, i.e. the number of waste containers hauled off, the large volume of recyclable waste that is disposed of in on-site trash receptacles represents a significant cost. In addition, such waste has a recycling value that is unrealized when the recyclable waste is disposed of in garbage.

Despite the challenges in collecting recyclable waste byproducts, uses for recycled waste are quickly expanding. For example, recycled plastic is now used in plastic garbage can liners, landfill liners, agricultural film, and composite lumber products for picnic tables, park benches, porches, and walkways where rot-resistant wood-like products are desired. Shipping containers, carpet materials, and hard plastic containers are also more and more frequently made with recycled plastics. This increased demand for products made from recycled materials is fueling an increased demand for the collection of recyclable plastic and other waste.

In addition, recent increases in the cost of raw petroleum have led to a dramatic increase in the cost of plastics for plastic products. As a result, the per pound value of collected recyclable plastic has also increased dramatically. This adds to the demand for the collection of recyclable plastic.

Nevertheless, the volume of plastic and other waste that is collected for recycling remains considerably lower than is feasible. One key imitation on the use of recyclable waste is that the waste is often difficult and costly to collect. For example, consumers using small plastic bags rarely return them to a source whereby they can be recycled. In addition, shrink wrapped plastic, garment bags and plastic clothing hangers at department stores are often discarded rather than collected. In particular, garment bags, shrink wrapped plastic and plastic clothing hangers at department stores and warehouse stores are often discarded because the volume of space required to store all the plastic accumulated within the store becomes too expensive to dedicate to that purpose. Although there are feasible methods for collecting such waste products, such as dedicated compactors and balers, these devices are too expensive and the volume of space that must be dedicated to storing pre-compacted recyclable waste is usually impractical for most businesses. For instance, the amount of plastic film or garment bags necessary to form an entire bale of only plastic may take weeks or months to accumulate.

By analogy, efforts at recycling cardboard have been much more successful. Cardboard recycling is performed at retailers, for example, by using large cardboard balers to compact waste cardboard and form the waste cardboard into bales for storage and transportation to cardboard recycling facilities. Cardboard balers are generally not used for plastic recycling, however, because they are much too large for the volume of plastic that is dealt with. Cardboard balers are typically designed to form forty-eight inch tall bales. The amount of loose plastic it would take to form a forty-eight inch tall bale simply cannot be stored by most, if not all, retailers. As a result, unlike cardboard, for which there is an efficient recycling infrastructure, there is currently no effective method for collecting large volumes of recyclable plastic.

In addition, cardboard cannot be mixed with plastic or other recyclable waste products for recycling. This is because they are completely different materials that are recycled by very different chemical and mechanical processes. There are also no efficient methods to separate such waste byproducts from cardboard since the value of either material does not justify the labor. For this reason, it is well known that the presence of plastic film, for example, in a cardboard bale leads to rejection of the entire bale such that it is discarded rather than recycled.

Accordingly, it would represent an advance in the art to provide systems and methods to more efficiently and less expensively collect and process recyclable waste byproducts for use in downstream recycling processes.

BRIEF SUMMARY OF THE INVENTION

The present invention relates to the collection of recyclable waste in bulk form. As noted above, the disposal or collection of recyclable waste from large retail stores, discount warehouses, and distribution centers has heretofore presented a significant cost to companies that made it inefficient or impractical. This difficulty in recovering recyclable waste results in the waste of a significant amount of otherwise recyclable materials and reduces profits for those that do collect and recycle the byproducts.

These problems are overcome by the herein disclosed methods for the collection of recyclable waste within composite bales formed through novel methods of using balers such as conventional cardboard balers. In general, a composite bale is formed of multiple types of recyclable materials. For instance, layers of recyclable cardboard can encompass one or more layers of a different type of recyclable waste byproduct. Thus, an amount of a type of waste insufficient to form a bale by itself is combined with one or more cardboard layers and compacted in a composite bale. As a result of these improved methods, a locale can use a cardboard baler not only to form cardboard bales, but also to form composite bales having any number of different recyclable materials therein.

Accordingly, a first embodiment of the invention is a composite bale formed of cardboard and some other type of recyclable waste. The bale generally includes a first layer of cardboard that is at least about six inches thick. The bale also includes a layer of recyclable waste on top of and in contact with the layer of cardboard. The recyclable waste layer itself may include multiple types of recyclable waste byproducts. For instance, by way of example, the layer may include used plastic bags, plastic film, aluminum cans, plastic bottles, plastic hangers, shredded paper, additional cardboard, and the like. The bale may also include a second layer of cardboard that is at least about three inches thick formed on top of and in contact with the layer of recyclable waste such that the layer of recyclable waste is sandwiched between the first and second layers of cardboard. The thicknesses of the first and second layers of cardboard can be used such that when the bale is compactly bound together, it maintains its structural integrity and thereby facilitates transportation and storage.

Another embodiment of the invention is a method for using a baler to collect recyclable waste. The method generally includes forming a composite bale of multiple recyclable materials by forming first and second layers of cardboard and forming therebetween a layer of recyclable waste that includes multiple types of recyclable waste byproducts. In forming the bale, the first and second layers of cardboard are formed with a thickness that allows a plurality of bales to be stacked on one another such that when the layers of cardboard and recyclable waste are positioned perpendicular to gravity, the bales do not lose structural integrity. In some embodiments, forming the layer of recyclable waste further includes enclosing all or some of the types of recyclable waste into plastic bags or other compressible containers. Plastic bags or plastic film can further be sandwiched between the bags of recyclable waste, either with or without a container of its own, to bond the bags of waste together and maintain the structural integrity of the bale during stacking, storage and/or transport.

Yet another exemplary embodiment of the invention is also a method for collecting recyclable plastic. The method generally includes providing a cardboard baler and operating the cardboard baler to compact a first layer of cardboard in the baler, a layer of recyclable waste formed on top of the first layer of cardboard, and a second layer of cardboard that is formed on top of the layer of recyclable waste. The layer of recyclable waste includes multiple types of recyclable waste byproducts and has a thickness of at least about three inches, while the first and second layers of cardboard are each at least about six inches in thickness.

These and other objects and features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF THE PREFERRED EMBODIMENTS

Reference will now be made to the figures wherein like structures will be provided with like reference designations. It is understood that the drawings are diagrammatic and schematic representations of presently preferred embodiments of the invention, and are not limiting of the present invention nor are they necessarily drawn to scale.

In the following description, numerous specific details are set forth in order to provide a thorough understanding of the present invention. It will be obvious, however, to one skilled in the art that the present invention may be practiced without these specific details. In other instances, well-known aspects of cardboard balers and recyclable waste byproducts have not been described in particular detail in order to avoid unnecessarily obscuring the present invention.

Figure 1:
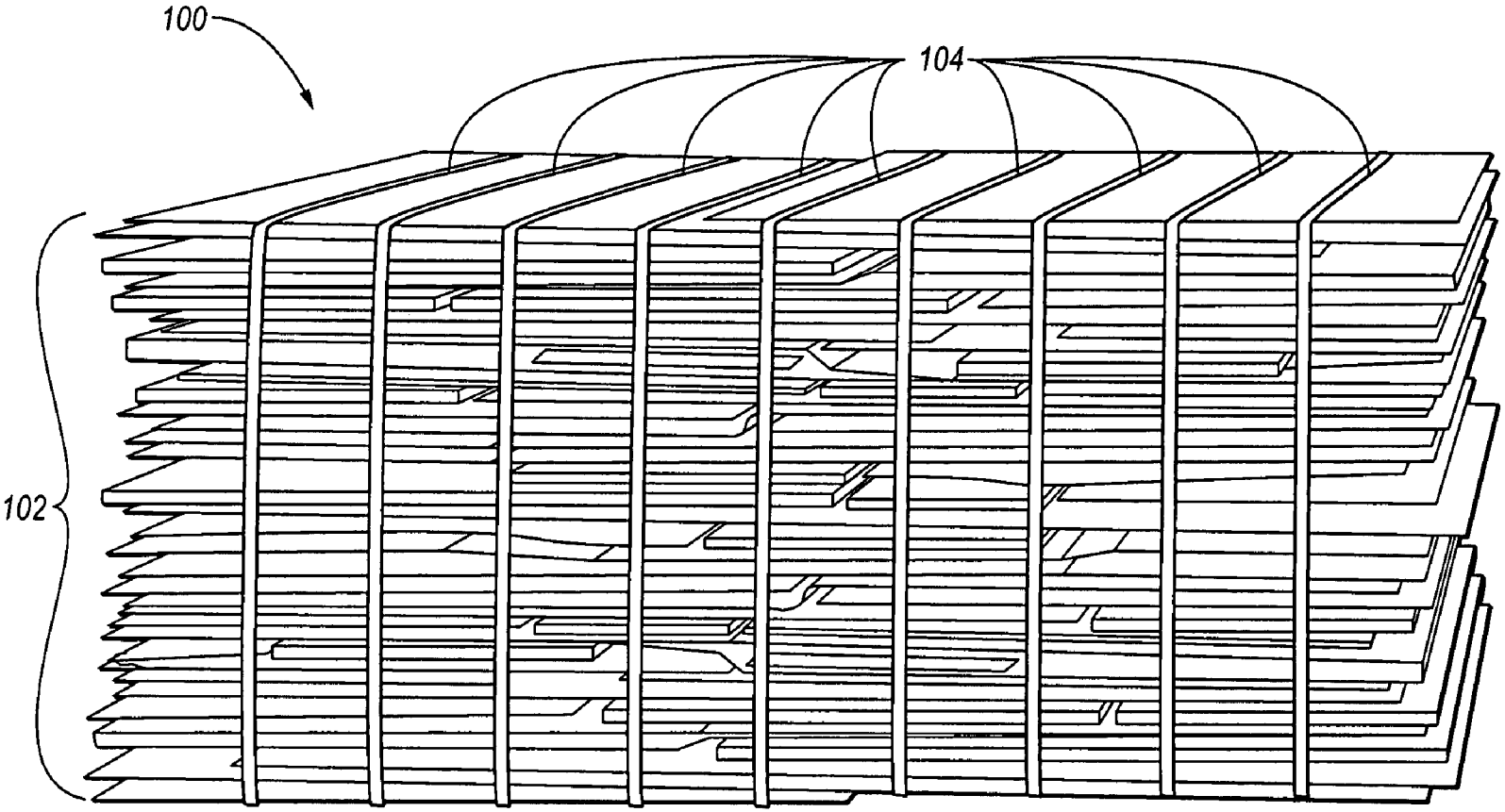
Fig. 1 (Prior Art)
FIG. 1 illustrates a cardboard bale according to the prior art.
Figure 4:
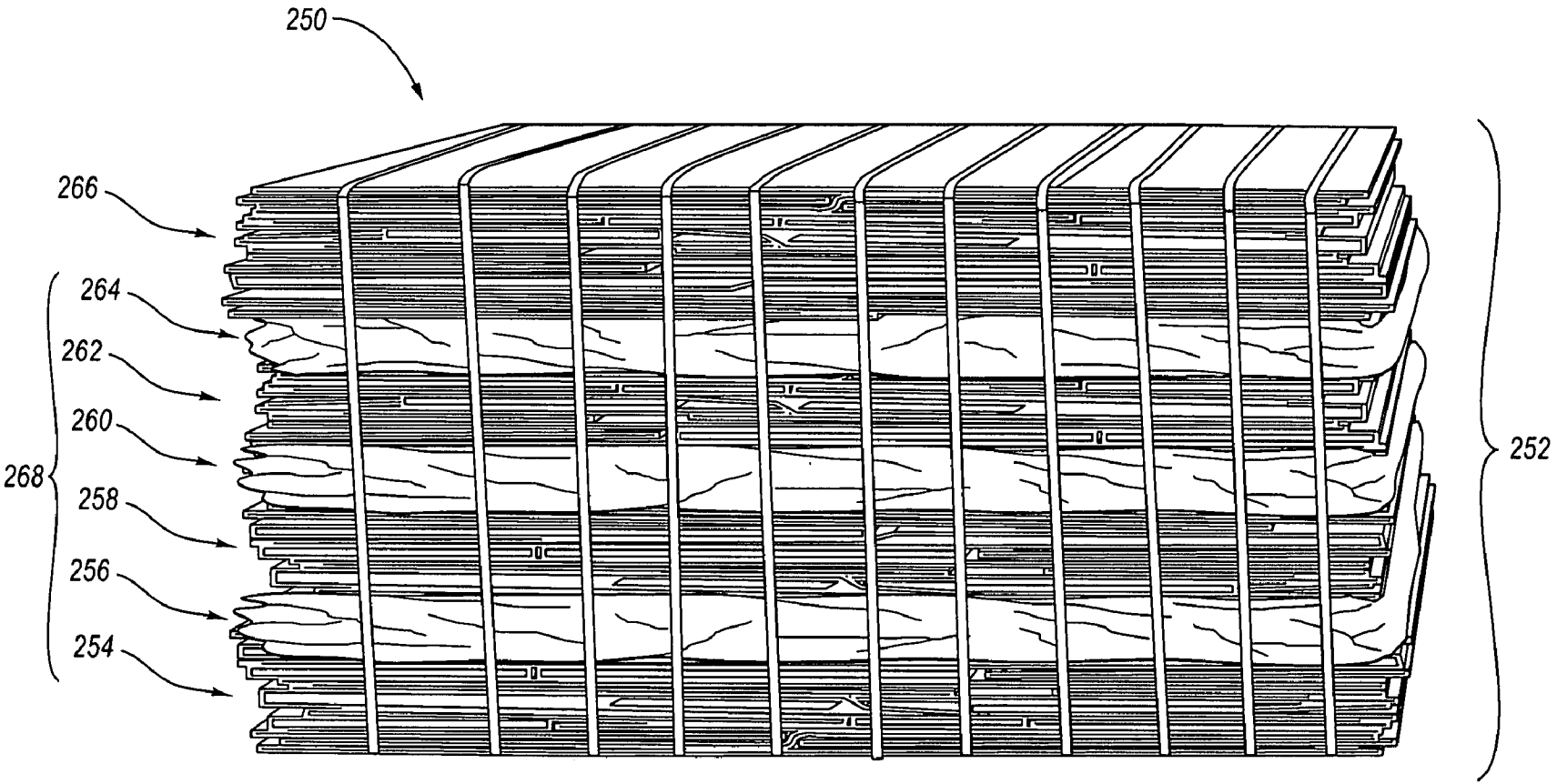
FIG. 4 illustrates a composite bale according to yet another embodiment of the invention.

Referring now to FIG. 1, a conventionally formed cardboard bale 100 includes a compacted single layer 102 of cardboard. As depicted, the compacted cardboard bale 100 is bound together by bands 104 to keep the cardboard bale 100 in a compacted state. Cardboard bale 100 can be formed by a cardboard baler as generally depicted in FIG. 4 or any other suitable baler or device used to compact cardboard. Typically, the majority of the individual pieces of cardboard that form cardboard bale 100 come from the same product distribution activities that generate most recyclable plastic film.

As previously noted, it has been conventionally held that cardboard cannot be mixed with plastic film or other types of recyclable waste byproducts in collecting the materials for recycling. More particularly, the chemical and mechanical processes for recycling cardboard cannot work if plastics, metals, or other recyclable materials are also present. It has therefore been axiomatic that cardboard bales, such as bale 100, cannot contain any plastic film or other recyclable waste byproducts, or the whole bale must be discarded. This is because not only can the materials not be mixed in recycling processes, but the cost of separating other recyclable waste from the cardboard is too high for cost-effective recycling. As a result, mixed bales of cardboard and types of recyclable waste have heretofore been discarded as waste.

Figure 2:
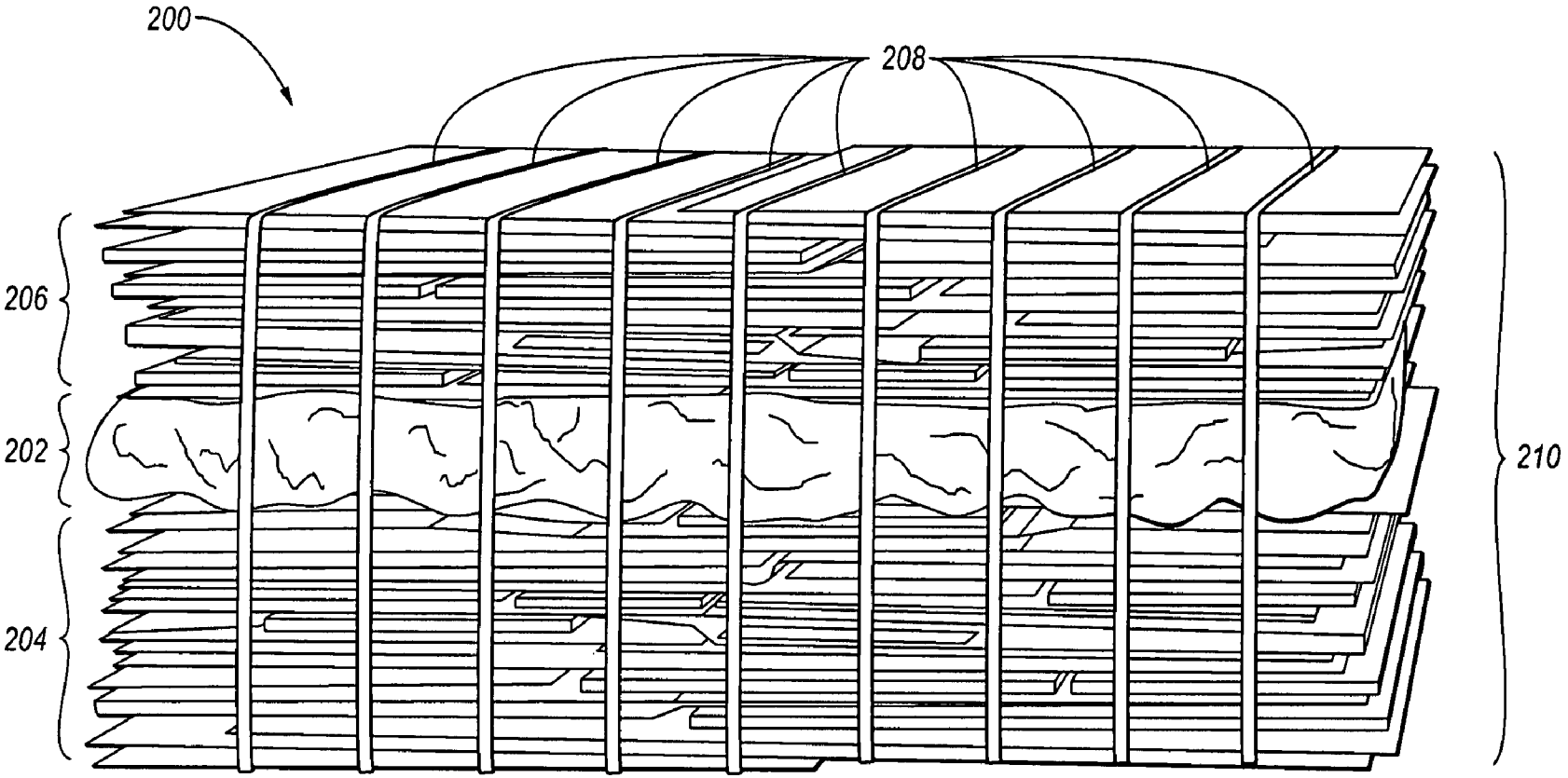
FIG. 2 illustrates a plastic/cardboard composite bale according to one embodiment of the invention.

Contrary to this conventional thinking, however, it has been surprisingly found that plastic bags, plastic film and other recyclable waste can be effectively combined with cardboard in forming a combined, composite bale. As generally depicted in FIG. 2, one embodiment of such a combined composite bale 200 incorporates a first layer 204 of cardboard, a layer 202 of plastic film and/or used plastic bags, and a second layer 206 of cardboard. The plastic layer 202 is in effect sandwiched between the two cardboard layers 204, 206. The compacted plastic/cardboard bale 200 is bound together by bands 208.

It can be readily seen in FIG. 2 how a significant amount of plastic film has been compacted to a very small space in the composite plastic/cardboard bale. In addition, it is also apparent that a significantly less amount of plastic is used in this plastic/cardboard bale than if the entire bale were formed of only plastic film. Thus, because a smaller amount of plastic film can be compacted in a single bale, the plastic can be disposed of in a timely fashion from a single location. In contrast, if the plastic were required to fill the entire bale, it would require many days, weeks, or even months to fill a single bale, requiring great expense to store a significant amount of un-compacted plastic.

Figure 3:
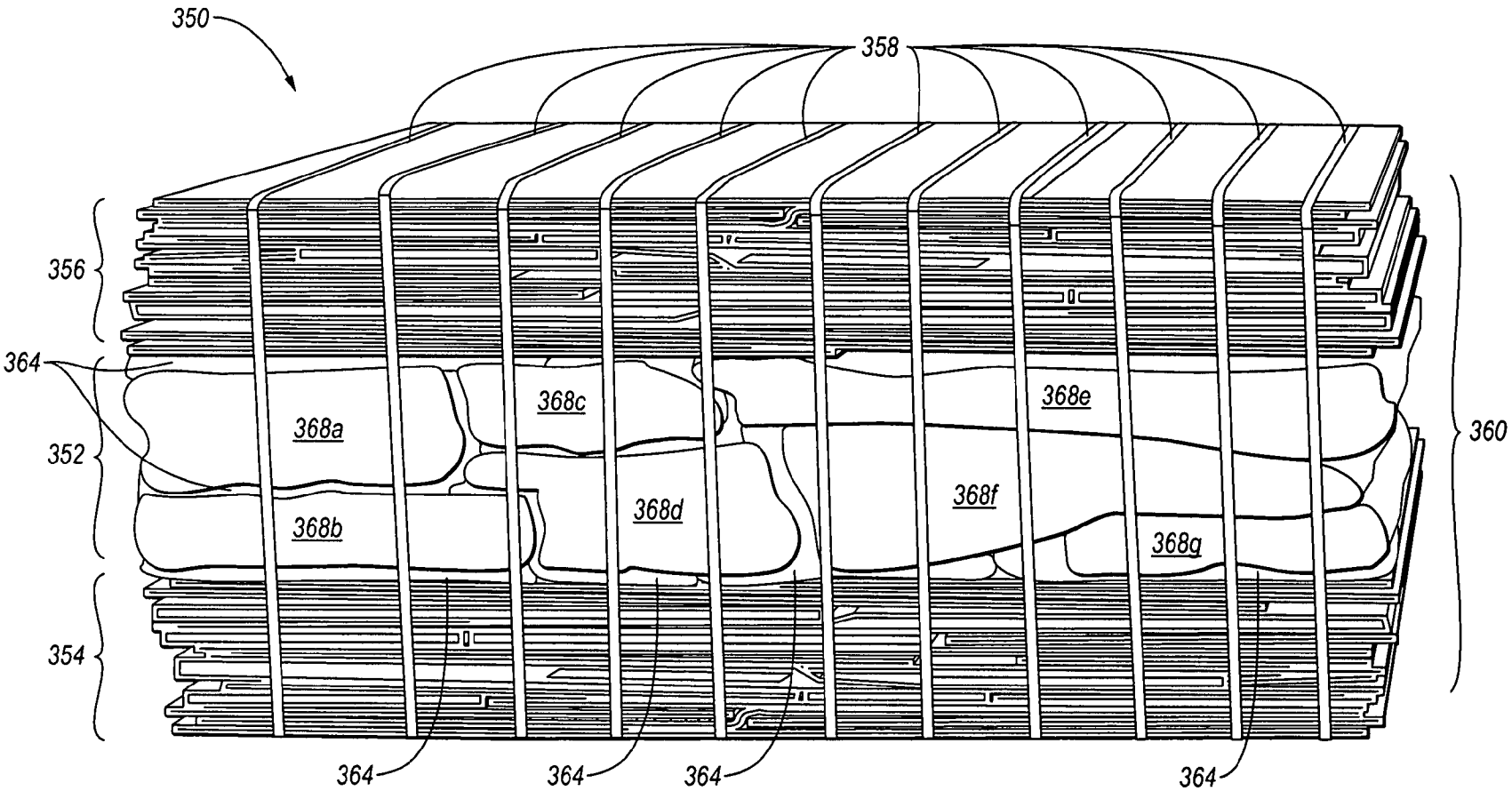
FIG. 3 illustrates a composite bale according to another embodiment of the invention.

Now referring to FIG. 3, an additional embodiment of an exemplary composite bale 350 is illustrated. As generally depicted in FIG. 3, composite bale 350 having a thickness 360 incorporates a first layer 354 of cardboard, a recyclable waste layer 352 of multiple types of recyclable waste byproducts, and a second layer 356 of cardboard. The recyclable waste layer 352 is in effect sandwiched between the two cardboard layers 354, 356. The compacted composite bale is bound together by bands 358.

Composite bale 358 acts as a complete packaging system in which a retail or wholesale distribution center—or any other location in which recyclable waste is produced—an package one or more types of recyclable waste byproducts into a single bale for shipment and delivery to a processing and/or recycling center. In the illustrated embodiment, for example, recyclable waste layer 352 includes a plurality recyclable portions 368*a-g* which include one or more types of recyclable waste. For example, each recyclable portion 368*a-g* may include one or more types of recyclable waste produced by a retail or wholesale distribution center. For instance, recyclable portions 368*a-g* may include plastic hangers, shredded paper, plastic or aluminum beverage containers, plastic fluid containers, shrink wrap, used plastic bags, and the like.

As will be appreciated, particularly in light of the disclosure herein, recyclable portions 368*a-g* may be of varying sizes, shapes and configurations within recyclable layer 352. In some cases, this variation results from the type of recyclable waste byproduct packaged in composite bale 350. More particularly, some recyclable waste products are highly compressible, such that when compacted in a baler, the volume the recyclable waste occupies in the bale can be significantly reduced. For instance, used plastic bags and plastic shrink wrap are pliable and also highly compressible. Similarly, plastic beverage containers, plastic fluid containers, and even aluminum beverage cans may contain a significant amount of air when discarded, and when compacted, the air can be discharged and the volume of the recyclable waste reduced.

Other recyclable waste, however, may be less compressible. For instance, plastic hangers do not capture a significant amount of air and are not pliable. Accordingly, when a volume of plastic hangers is compressed in a baler, the hangers maintain much of their original shape, thereby resulting in compression that can be much less significant than the compression of the same volume of, for example, plastic film or plastic beverage containers.

Accordingly, and as illustrated in FIG. 3, when recyclable portions 368*a-g* are compressed and baled, the shapes, sizes and configurations of each portion can vary. For instance, a recyclable portion with plastic hangers (e.g., portion 368*d*) will result in a greater thickness within composite bale 350 than a recyclable portion of the same volume that is filled with a more compressible material (e.g., portion 368*g*).

As discussed in greater detail herein, different recyclable waste byproducts can be packaged separately within composite bale 350. For instance, recyclable portions 368*a-g* can each be packaged within a compressible container such as, for example, a plastic bag made of a plastic film material. Separating materials into a containers is desirable for a variety of reasons. For example, waste byproducts may be generated at different locales within a retail or wholesale distribution center such that it is more convenient for each different locale to package its recyclable waste byproducts separately. In addition, as discussed in more detail hereafter, such separation may facilitate handling of the byproducts at a processing or recycling center.

In one embodiment, the compressible container is a deformable plastic bag container. For instance, in one embodiment, the various recyclable waste products can be enclosed within a used shopping bag or clothing bag, such that the recyclable waste is enclosed within other types of recyclable waste byproducts. In other embodiments, however, the compressible container is not a waste byproduct. For instance, a plastic bag may be obtained for the purpose of packaging of the recyclable waste and not generated by the day-to-day operations of a retail, wholesale or distribution center.

With continued reference to FIG. 3, it will be seen that in some embodiments, a composite bale which packages multiple types of recyclable waste byproducts and/or waste byproducts which are not highly compressible, may further be configured to maintain its structural integrity during storage and shipment of the composite bale. For instance, composite bale 350 is adapted to maintain its structural integrity where a potential weak point otherwise exists in the bale.

In particular, when different portions 368*a-g* of recyclable waste byproducts are compressed together, they may become rigid and/or not conform to the shape of an adjacent portion. Consequently, when the bale is created, the different portions can shift position during storage and/or transport, thereby weakening the bale. To reduce the effect of such weak points, composite bale 350 optionally includes bonding agents 364 between some or all of recyclable portions 368. Optionally, bonding agents 364 can be placed in recyclable layer portion 364 between recyclable portions 368*a-g* and first and second layers of cardboard 354, 356.

The bonding agent acts to stabilize the position of recyclable portions 368*a-g* relative to an adjacent recyclable portion and/or first and second layers 354, 356. In one embodiment, for example, bonding agent 364 includes a compressible material that is sandwiched between two or more of recyclable portions 368*a-g*. As a result, when a baler compresses bonding agent 364 and recyclable portions 368*a-g*, the compressible bonding agent 364 can conform to the shape of the adjacent recyclable portions, thereby eliminating or reducing the space between portions and further increasing the structural integrity of the bale.

Bonding agents 364 may comprise any suitable material. For instance, in one embodiment, bonding agents 364 include compressible, recyclable waste byproducts generated by a retail, wholesale or distribution center that packages its recyclable waste into composite bale 350. For instance, byproducts such as plastic film or used plastic bags can be placed between different containers of other recyclable waste products to bond them together and increase the bale strength. Such recyclable waste may be directly placed between recyclable portions 368*a-g* or, in other embodiments, may be placed within a container such as a plastic bag, and the plastic bag then sandwiched between different recyclable portions.

Although it is preferred to have cardboard layers both above and below plastic film layer 202 (FIG. 2) and/or recyclable waste layer 352 (FIG. 3), other embodiments of the invention may use only a single cardboard layer on one side of a plastic film layer or other type of recyclable waste layer. Alternatively, a composite bale may have numerous layers. For example, FIG. 4 illustrates a recyclable waste layer 268 which comprises several intermediate layers 256, 258, 260, 262, 264 sandwiched between a top cardboard layer 266 and a bottom cardboard layer 254 to form a composite bale 250 having a thickness 252. In the illustrated embodiment, several of the intermediate layers may also comprise cardboard (e.g., intermediate layers 258, 262), sandwiched between layers comprising other types of recyclable waste (e.g., intermediate layers 256, 260, 264).

As will be appreciated in light of the disclosure herein, intermediate layers 256, 260, 264 can include any type of recyclable waste. For instance, each of intermediate layers 256, 260, 264 could comprise the same type of recyclable waste. By way of example, each intermediate layer may comprise only plastic film. In other embodiments, intermediate layers 256, 260, 264 include multiple types of recyclable waste. For instance, and by way of representation only, intermediate layer 256 may comprise bags of plastic film, intermediate layer 260 may comprise shredded paper, and intermediate layer 264 may comprise plastic bottles. It will readily be appreciated, however, that each intermediate layer 256, 260, 264 may also contain more than one type of recyclable waste byproduct, such that multiple intermediate layers may contain the same and/or different types of recyclable waste.

Of course, one skilled in the art, in view of the disclosure herein, could configure a composite bale with any number of layers of recyclable waste, with any number of intermediate layers of recyclable waste or cardboard, and which include any of various types of recyclable waste. The limiting factor is that the thickness of each intermediate layer of recyclable waste, and the number of such intermediate layers must be cost effective. This use of numerous intermediate layers may be preferable in locations where there is little storage space for loose or collected recyclable waste or cardboard, and so it is desirable to frequently compact the on hand loose and collected waste and cardboard in multiple layers. It may also be useful where, for example, different departments or service centers deliver their waste to the a baler at different times, so as to allow compaction of the various types of recyclable waste from a department or service center upon delivery of the waste to the baler.

Figure 5:
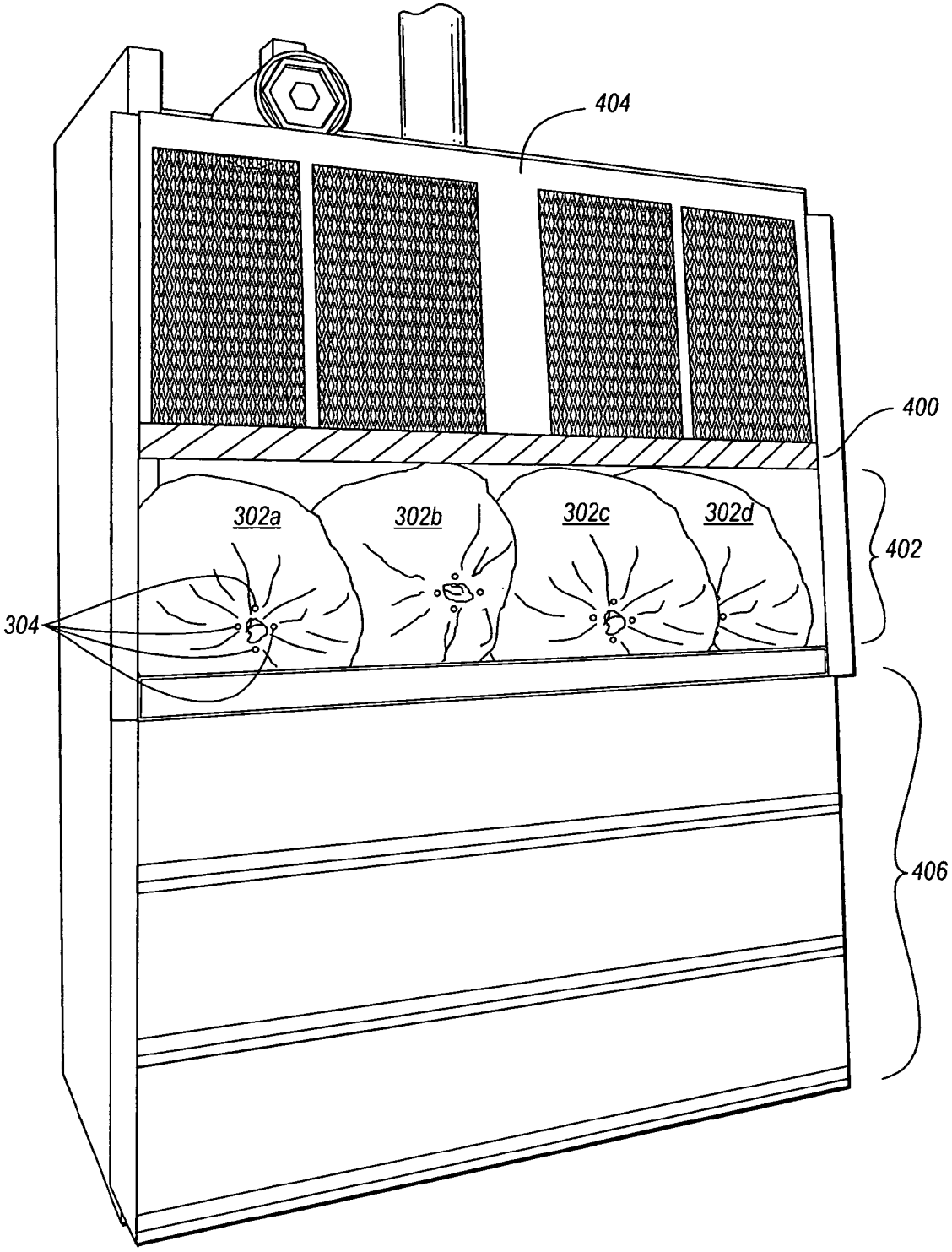
FIG. 5 illustrates the insertion of recyclable waste byproducts into a cardboard baler for forming a composite bale according to embodiments of the invention.

With reference now to FIG. 5, a conventional cardboard baler 400 is used to form composite bales according to embodiments of the invention. Using conventional cardboard balers greatly reduces the cost to retailers and distributors that already have the balers on-site in that they do not have to acquire another machine nor do they have to store two or more machines, one for cardboard and one for each type of recyclable waste byproduct. The construction and operation of conventional cardboard balers, such as for example cardboard baler 400, is well known in the art and will not be described in great detail herein. Most conventional balers are designed to form 48 inch, 60 inch, or 72 inch bales.

Generally, it can be seen that cardboard, plastic, and other types of recyclable waste byproducts can each be inserted through a top opening 402 while a gate 404 is in the open position. In the illustration, a series of bags 302*a-d* containing recyclable waste have been inserted into baler 400. Although not visible in the illustration, a layer of compacted cardboard of preferably three to eighteen inches, and more preferably from twelve to eighteen inches, is already formed below uncompacted plastic bags 302*a-d* in the bottom portion 406 of baler 400. After gate 404 is closed, baler 400 can then be operated to compact plastic bags 302*a-d* into a compacted recyclable waste layer over the previously compacted cardboard layer. It some embodiments, and with some types of recyclable waste, is preferable to load and compact several cycles of recyclable waste, for example eight to twelve cycles, to form an ideally sized recyclable waste. For example, a preferred recyclable waste layer may be from about three inches to about thirty-five inches in thickness, or more preferably from about nine inches to about eighteen inches in thickness.

In some embodiments, such as that illustrated in FIG. 5, plastic bags 302*a-d* may include one or more air release holes 304. Release holes 304 are, in this embodiment formed near the neck of bags 302*a-d* and are configured to allow air to be easily released from bags 302*a-d* when bags 302*a-d* are compacted by baler 400. One feature of holes 304*a-d* is that as bag 302*a-d* is compressed, air can easily flow through bags 302*a-d*, thereby preventing breakage or rupture of bags 302*a-d* that could otherwise occur were air to be trapped inside the bags. Should rupture to occur, the recyclable waste enclosed within bags 302*a-d* could become separated from the bale and/or create voids within the bale. In either case, a weak point in the bale structure may be created, such that prevention of such facilitates maintenance of the structural integrity of the compacted composite bale.

While four release holes 304 are illustrated near the neck of each of bags 302*a-d*, it will be appreciated that this is exemplary only and that any number and placement of holes 304 is contemplated. For example, holes 304 may be positioned at the bottom of bags 302*a-d*, along the length of bags 302*a-d*, or any combination thereof. In other embodiments, bags 302*a-d* are made of a breathable material such that air can be expelled sufficiently through the surface of the bag.

Plastic bags 302*a-d* may further be made of a pliable material that stretches to prevent rupture or breakage before or during compression of the bag by baler 400. This feature may be particularly desirable for some types of recyclable waste byproducts that are rigid, have sharp edges, or which are not highly compressible. For example, plastic clothing hangers may be placed in a flexible bag when they are discarded. To maximize the number of hangers in the bag, the hangers may be manually compressed into the bag, thereby causing the hangers to push against the interior surface of the bag, causing it to tear. By using a bag that stretches, however, the bag may have sufficient give to allow the contents of the bag to shift, and the bag stretches without rupturing. Similarly, when such materials are compacted by cardboard baler 400, the contents of each bag can shift, thereby pushing against the bag and causing it to tear or stretch.

In some embodiments where bags 302*a-d* are plastic and flexible, bags 302*a-d* are made of a linear molecular plastic that stretches to prevent popping, tearing, or splitting of the bag. For example, the bags may be made of a non-porous linear low density polyethylene (LLDPE), although other types of bags are contemplated. For example, in other embodiments, the bag is not stretchable, is porous, and/or is not made of a plastic or polymer material.

After the recyclable waste layer is formed, an operator preferably inserts a cycle of cardboard and then operates baler 400 to compress a layer of cardboard over the recyclable waste layer. This top layer may be formed over several load cycles and preferably has a thickness of about three to eighteen inches, and more preferably from about twelve to eighteen inches. Finally, the finished bale is bound, preferably with wire in contrast to conventional plastic bands, so as to keep the bale compacted, after which it is then ejected from the baler 400. Preferably the bales have two wires at each end to further bind the bales.

Figure 6:
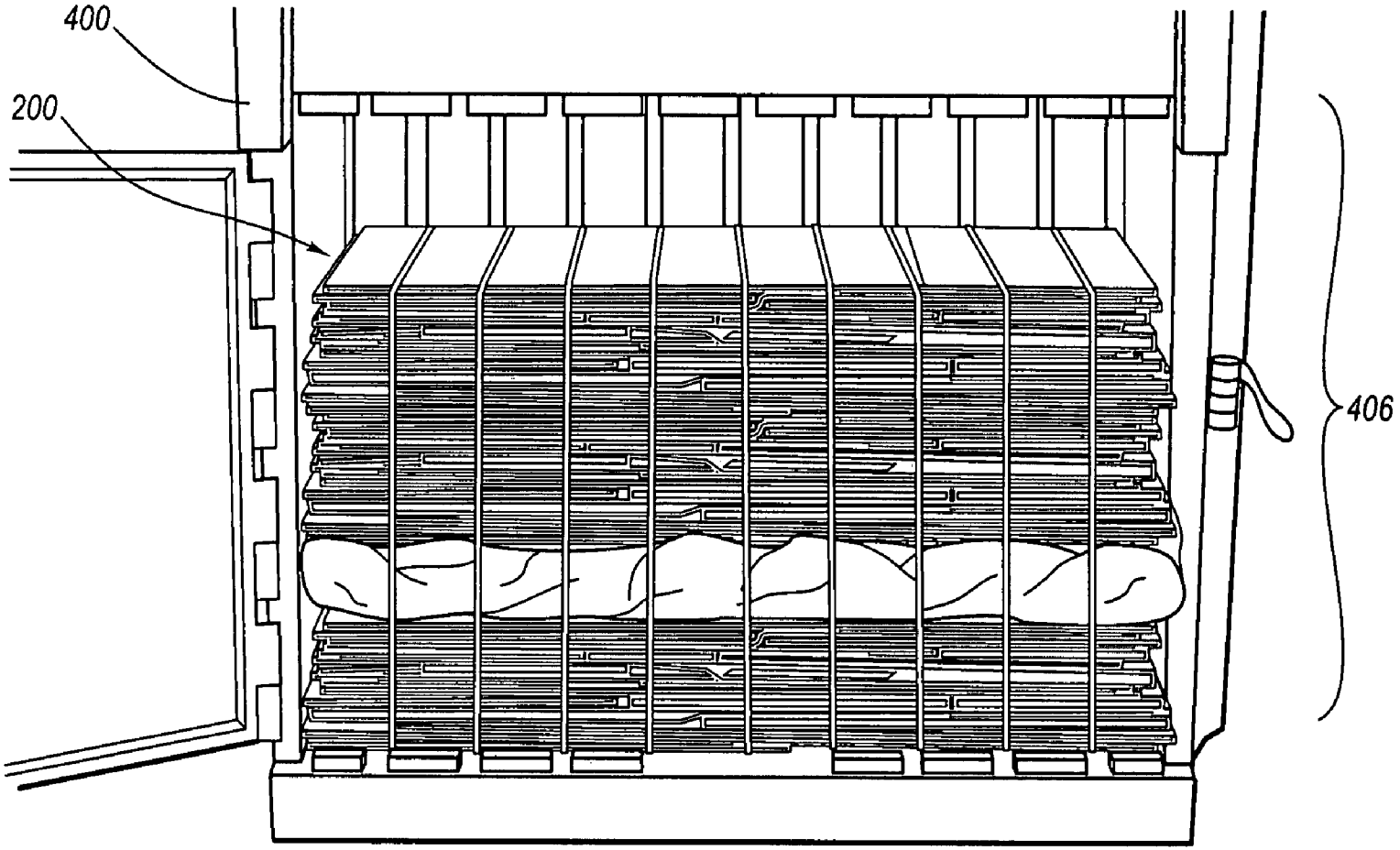
FIG. 6 illustrates a composite bale formed in a cardboard baler according to embodiments of the invention.

FIG. 6 illustrates a completed and bound composite bale 200 seated within bottom portion 406 of baler 400. Alternatively, as illustrated in FIG. 4 and previously discussed, multiple layers of recyclable waste and/or multiple intermediate layers within a recyclable waste layer, can be formed within a single bale and/or top or bottom cardboard bales can be omitted in some embodiments.

Figure 7:
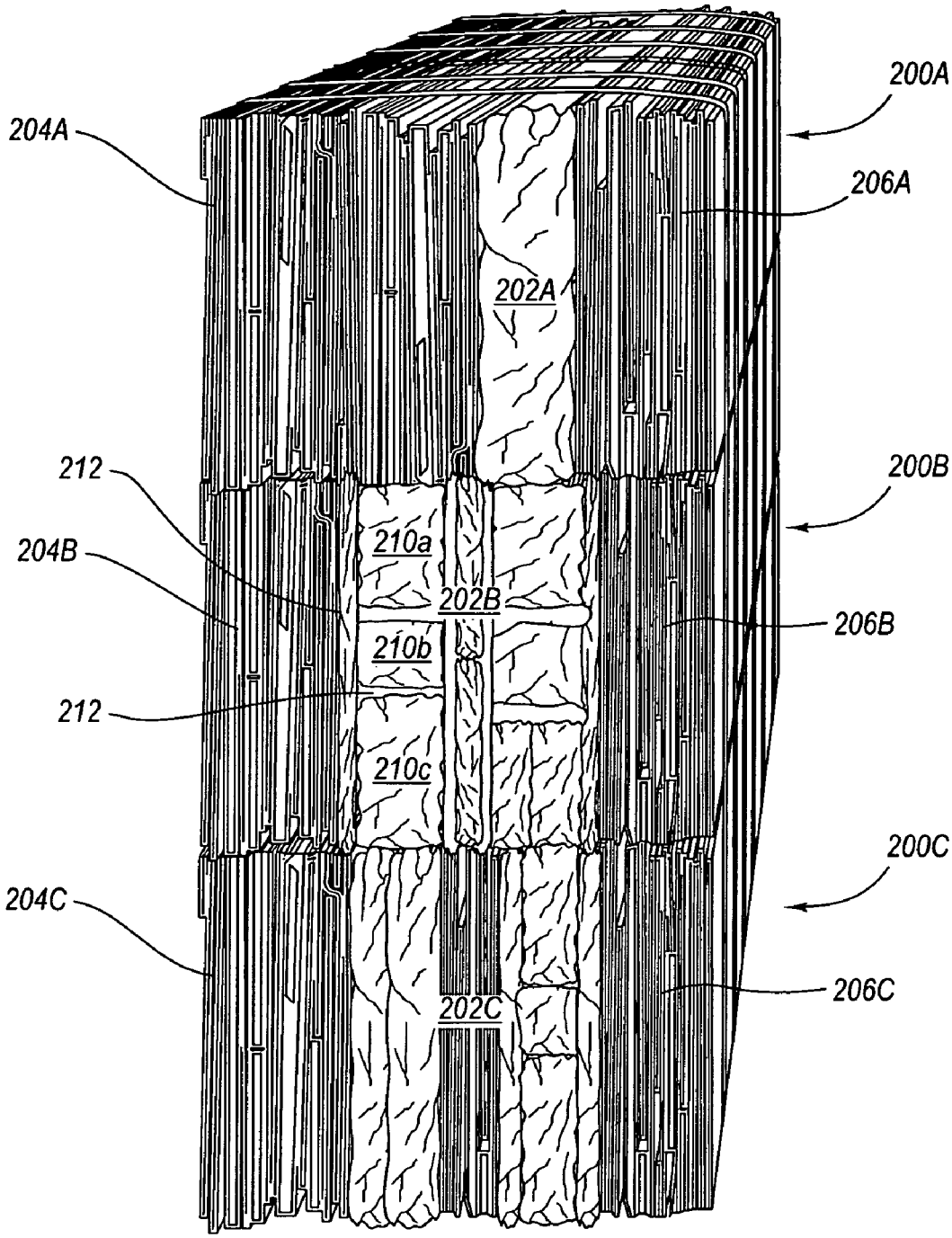
FIG. 7 illustrates a series of composite bales stacked for storage and/or transportation according to another embodiment of the invention.

Referring now to FIG. 7, forming stacks of composite bales 200A-C is important in the recycling industry because it allows for economy of storage and transport efficiency. As shown in FIG. 7, completed composite bales 200A-C are typically stored for a time at distribution and recycling centers stacked on top of one another to conserve space. During transport to these locations, bales may also be stacked on top of one another on a flat-bed trailer. As the trailers travel, turn corners, bounce, etc., the need for increased stability is important as bales shift and tend to lose their structural integrity. The weight of these bales is often over one thousand pounds, accentuating the tendency of the bales to shift and lose structural integrity.

The structure of the inventive bales is particularly beneficial in that having cardboard layers 204A-C, 206A-C sandwich recyclable waste layers 202A-C forms structural bookends that allow the bales to maintain form and be transported safely and effectively. In other words, whereas the recyclable waste layers are not strong enough to effectively stack perpendicularly on their own, the cardboard end layers provide excellent structural integrity so the bales can be stacked with the layers perpendicular to gravity without collapsing. The top and bottom cardboard layers 204A-C, 206A-C therefore preferably each have a thickness of at least about twelve inches to provide good support, but as few as six inches or even three inches may also be used in some embodiments.

In addition, the cardboard ends of the composite bales allow the bales to be tightly secured by straps tightened by a winch on a flat-bed trailer without the force of the straps breaking the bales apart.

As noted previously in the discussion with regard to FIG. 3, a composite bale according to the present invention can further be adapted to maintain its structural integrity where the materials in the recyclable waste layer would otherwise create a potential weak point in the bale. For example, a bag of materials that are not highly compressible (e.g., plastic clothing hangers), may maintain its approximate shape when compressed, such that it does not mate well with an adjacent bag of the same or different material. By not conforming or mating with the shape of an adjacent bag, a void in the bale is created, thereby also creating a weak point at which the bale can lose its structural integrity.

As illustrated in FIG. 7, however, a recyclable waste layer of a bale may include one or more other recyclable materials that facilitate mating of various bags of recyclable materials. For instance, recyclable waste layer 202B of composite bale 200B includes bags 210*a-c* of recyclable waste by products. To improve the structural integrity of bale 200B, a bonding agent 212 is placed between each of bags 210*a-c*, and in contact with each adjacent bag. Bonding agent 212 is adapted to conform to the shape of adjacent bags and thereby mate the bags together such that voids are reduced in bale 200B.

Any number of bonding agents are contemplated and suitable for this purpose. For instance, in one embodiment, a bonding agent may be a recyclable material that is highly compressible such that it can conform to the shape of an adjacent bag. For instance, bonding agents 212 may be other, more compressible recyclable waste byproducts. By way of example only, plastic film or used plastic bags may be placed between bags 210*a-c* and act as bonding agent 212. One advantage to the use of plastic film or used plastic bags is their wide availability to retail and wholesale centers in the packaging and distribution of products, as described herein. Accordingly, the bale can be formed of recyclable waste products without the need to obtain or acquire additional products merely to strengthen the bale. In addition, and as will be appreciated in light of the disclosure herein, plastic bags and/or plastic film used as bonding agent 212 may be placed directly in the baler between bags 210*a-c*, or may itself be placed in a bag which is then compressed between bags 210*a-c*.

Accordingly, one embodiment of the invention is a method of transporting or storing composite bales by stacking two or more composite bales, wherein each of the bales has a cardboard layer, perpendicular to the stack, on each end of each bale such that the bales do not lose structural integrity and do not collapse. Such cardboard layers preferably have a thickness of least about three inches, more preferable at least about six inches, still more preferably at least about twelve inches.

In addition to providing structural support, the top and bottom cardboard layers 204A-C, 206A-C, and bonding agent 212, also help contain loss of debris when bales 200A-C are transported on an open flat-bed trailer. Cardboard is less likely to pull loose in the wind than plastic or other smaller recyclable materials and so having cardboard at the end pieces reduces the likelihood of the bale contents being pulled loose. The cardboard layers are also beneficial when the bales are stored on the ground in that the cardboard absorbs water, reducing the amount of water entering the layer of recyclable waste byproducts. Of course, one skilled in the art will also appreciate that bales 200A-C can also be stored above the ground, such as on a pallet, to prevent or reduce exposure of the bale to water.

One example process of implementing the invention involves first gathering recyclable waste to a single location. Such waste may include plastic, paper, metal, or other recyclable materials generated or produced on-site. For example, plastic shrink wrap used to package shipped products, plastic garment bags or clothing hangers removed from clothing prior to or at the time of sale, shredded paper, aluminum beverage cans, plastic beverage bottles, blow molded plastic one gallon or one quart containers, and the like. Such waste byproducts may also be gathered from other locations. For example, a collection location may have a collection program wherein consumers can return their aluminum cans, beverage bottles, or small plastic grocery or shopping bags for recycling. In addition, such items can be collected throughout a community, such as at local schools, to promote recycling and thereby provide the double effect of providing a revenue stream for the store (sales of recyclable waste) and by generating community goodwill.

Figure 8:
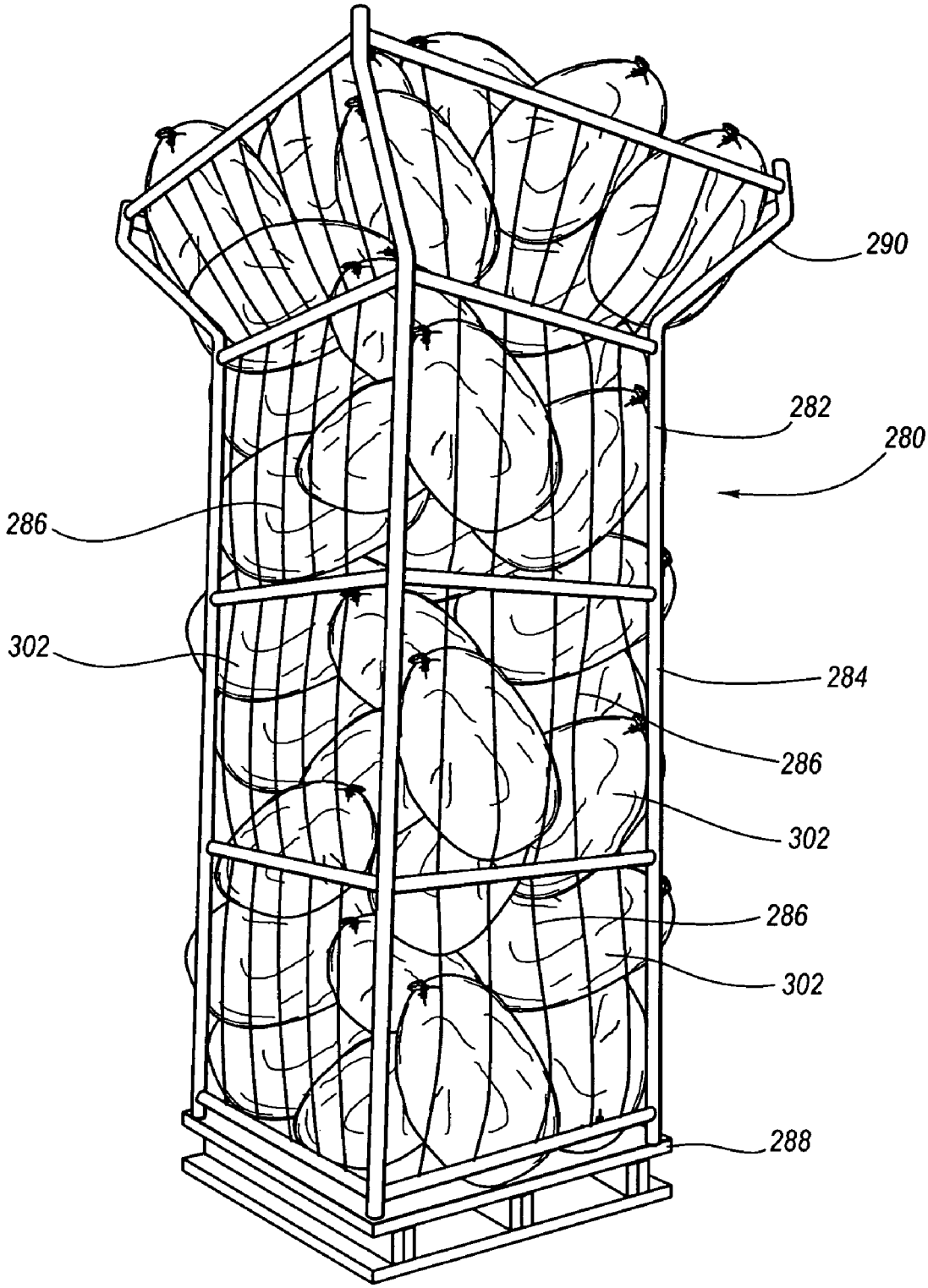
FIG. 8 illustrates a bin for storing recyclable waste prior to its compacting into a composite bale according to another embodiment of the invention.
Figure 9:
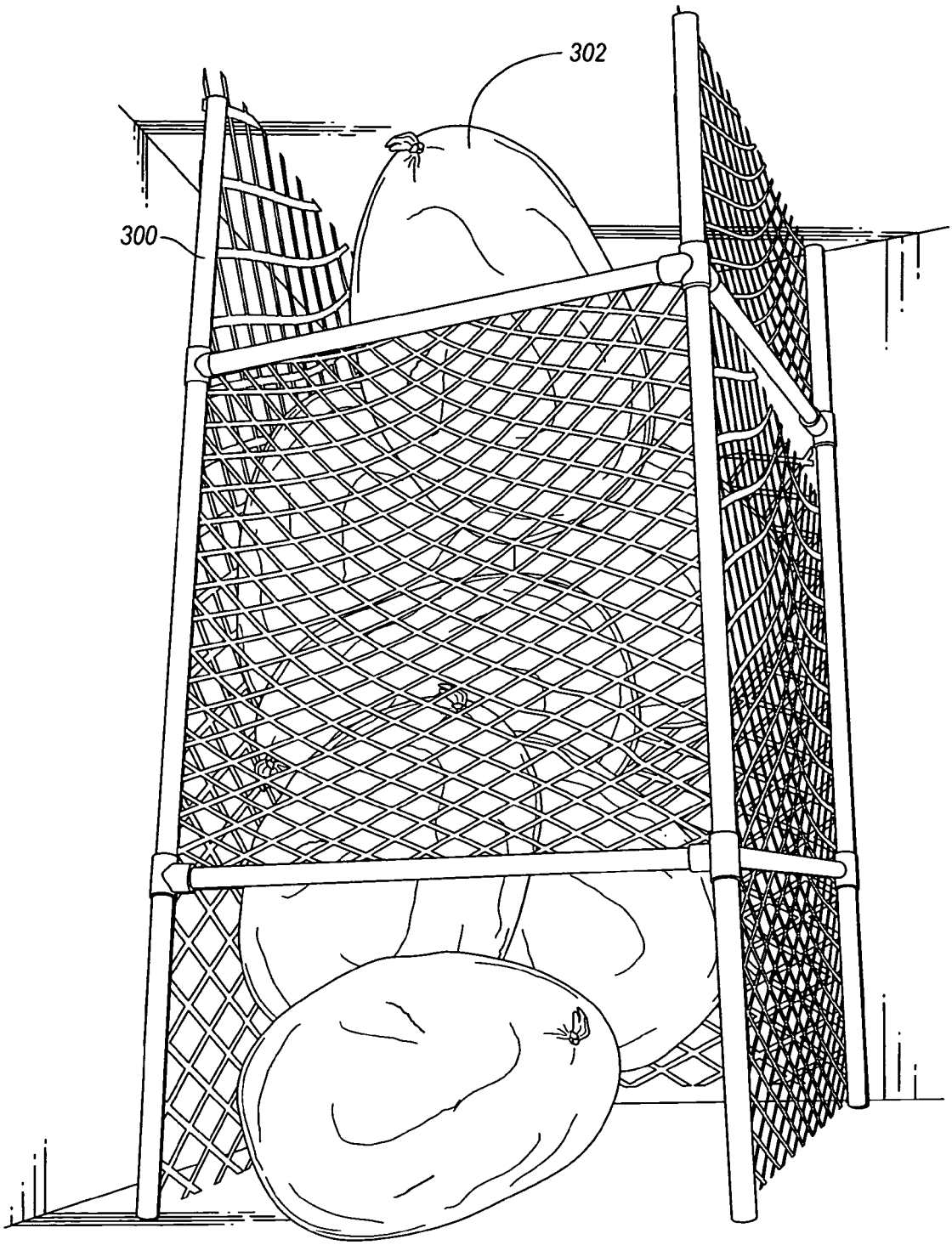
FIG. 9 illustrates another bin for storing recyclable waste prior to its compacting in a composite bale according to another embodiment of the invention.

The gathered waste must then be stored for a brief period of time. Storing recyclable waste according to one embodiment of the invention includes providing a specially designed collection area. As seen in FIGS. 8 and 9, such a collection area may be for example a tall narrow ball bin 280, 300 similar to those currently used to store large rubber balls and the like. Within a ball bin 280, 300 a plurality of single plastic bags 302, such as a garbage bags, or other suitable bags or containers such as those described herein, are filled with the accumulated recyclable waste materials. The plastic bags 302 are preferably themselves recyclable plastic film bags, although it will be appreciated that this is not necessarily a limiting feature of the present invention.

A ball bin 280, 300 can be conveniently located near a cardboard baler so that bags 302 of recyclable waste can be stored vertically to minimize occupied floor space. Optionally, each locale at which recyclable waste is located has its own one or more collection bins. Accordingly, and by way of example, grocery and clothing departments may have their own bins, an auto servicing area may have its own bin, a vending/restaurant area may have a separate bin, an office center may have yet another bin, and so forth. The ball bins can also be formed or placed on a pallet 288 or wheeled dolly so it can be moved as desired. In the embodiment of FIG. 8, the ball bin 280 can have a lightweight frame 282, for example formed of PVC or some other hollow tubing. The depicted ball bin has a funneled top opening 290 and plurality of bungee cords or ropes 286 that keep bags 302 from falling out. For storage, plastic bags 302 can be either tossed in through the funneled top opening or pushed between the movable bungee retainer cords 286. The bags can then be removed for compacting by pulling them through the movable bungee retainer cords 286. In the depicted embodiment of FIG. 9, in another example the ball bin may also be a metal cage having top and bottom openings where the plastic bags 302 can be tossed in and removed.

The bags of recyclable waste are preferably stored in a ball bin until it is completely full. That volume of recyclable waste is then loaded into the baler over a series of compacting cycles to make a composite bale. It has been determined, for example, that one bin of approximately four feet in width, four feet in depth, and ten feet in height can hold the plastic generated over two to three days by a typical large retail store or discount warehouse.

It is preferable to make each recyclable waste layer as thick as possible to reduce the number of composite bales. Fewer composite bales is preferable since it reduces the number of bales that need to be specially handled. It is estimated that large retail stores using a ball bin as describe herein to store and recycle only plastic film will generate approximately one composite plastic/cardboard bale for every eight or nine cardboard bales. Where additional recyclable materials are included in the composite bale, the ratio of composite bales to only cardboard bales may decrease such that it is even more desirable to may the recyclable waste layer as thick as possible.

Upon formation of a composite bale, such as for example composite bale 200 or composite bale 250. The composite bale can then be stored on-site until it is shipped to a processing center, optionally via other distribution locales such as return centers. Because, the recyclable waste has been compacted in the composite bales, it takes up the less space in a trailer or other transportation vehicle as a similar weight of loosely gathered plastic film.

At the downstream processing center the bale is separated into its constituent parts, for example, with reference to FIG. 2, first cardboard layer 204, plastic layer 202, and second cardboard layer 206. With respect to FIG. 3, bale 350 is separated into first cardboard layer 354 and second cardboard layer 356, and the bags within recyclable waste layer 353 are further separated. Because the recyclable waste layer in the composite bale is contiguous, the compacted layer can be easily and readily removed and isolated for recycling. Moreover, where each bag contains only one type of recyclable waste product, the various types of waste products do not contaminate each other nor the cardboard.

Cardboard balers typically form bales that are about forty-eight inches tall, about sixty to seventy-two inches wide, and about thirty inches deep. A single recyclable waste layer, in turn, may comprise from about three inches to about thirty-six inches or more in height. Alternatively, the layer of recyclable waste can be described as being at least about 5% of the bale thickness, more preferably from about 10% to about 70% of the bale thickness. While less than about 3 inches, or less than about 5%, can be used in embodiments of the invention, and particularly for plastic products, unless the price per pound for recyclable plastic becomes very high, it is significantly less financially feasible to process a bale to collect such a relatively small volume of plastic. In addition, having at least about 30% cardboard in each bale helps ensure sufficient rigidity for bale stability and containment of the recyclable waste.

A lower cardboard layer will preferably be from about 5% to about 95% of the bale thickness, more preferably about 25% to 75% of the bale thickness. The optional top cardboard layer is preferably thinner than the bottom cardboard layer such that it can be more easily removed-when the bale is disassembled. A top cardboard layer thickness of about three to twelve inches, more preferably about six inches to about nine inches, is therefore preferred. Although not necessary, the use of the top cardboard layer is preferred as it helps keep the bale more compact and intact than it would be if recyclable waste were on the top of the bale.

Of course, the denotations of top and bottom are interchangeable and the bales can be formed in an inverse manner to that described hereinabove.

Various approaches can be used to track the weight of recyclable waste that is pressed into each composite bale. One efficient manner of keeping track of the volume of recyclable waste that is compacted in each bale is simply to measure the thickness of each layer of a distinct type of recyclable material and multiply that thickness times other known constants such as the dimensions of the bale to determine an approximate volume. This number is particularly helpful for use in determining the value of the recyclable plastic film that has been recovered.

For example, it is currently known that every three inches of compacted plastic film in a bale measuring sixty inches by forty-eight inches by thirty inches weighs about fifty pounds. A seventy-two inch by forty-eight inch by thirty inch bale, in turn weighs about sixty-five pounds. Thus, upon the formation of the bale the thickness of a layer of plastic film can be approximately measured in inches and a weight estimate can be made.

Alternatively, the thickness of a recyclable waste layer can be estimated as a fraction of the bale thickness. Regardless, the entire bale can also be weighed so that the correct fractional portion of the load is assigned to the recyclable waste.

In yet another alternative, past measurements of the various types of recyclable waste byproducts included in the composite bales can be used. For instance, for a particular size of bag, historical averages for the various types of recyclable waste can be calculated and used to approximate the weight of each type of waste material in the bale. Accordingly, upon creation of the bale, the retailer or other person can indicate on the bale, or on the shipping documents, the number of bags of each type recyclable waste byproduct that are in the bale. In this manner, when the bale is received by the processing center, the processing center can calculate the approximate weight of each recyclable material even without separating the bale. Of course, the processing or recycling center can also separate the bale and count the bags of each type of product to, for example, verify the retailer's count and/or to update historical average data.

In other embodiments, the historical weight averages may be used even without an indication by the retailer of the number of each type of product in the bale. For instance, the processing center may merely separate the bale and count each type of bag. To facilitate such counting, each bag may contain only one type of recyclable waste byproduct. In such cases, when a bale is created, recyclable waste such as plastic film, used plastic bags, HDPE bottles, PET bottles, aluminum cans, plastic hangers, shredded paper, and the like may not be combined into a single bag, but each packaged separately in one or more bags. Further, each type of byproduct may be enclosed in a different color bag such that the byproduct therein can easily be identified by the processing center even without opening the bag. In alternative embodiments, indicia may be provided on the container enclosing the byproduct (e.g., a description or picture of the byproduct) to facilitate identification, or the bags may not include any indicia or other method for distinguishing between types of content.

If a more accurate measurement of the recovered waste products is desired, then the whole bales can be again weighed at the processing or recycling center. Thereafter, after the bales are broken open and the various types of recyclable waste are separated from the cardboard, each bag or each type of byproduct can once more be weighed to get a final accurate measurement of the recovered amount. Of course, not all of these measurements may be necessary depending upon the accuracy and tracking that is desired.

After sorting the cardboard and byproducts, each of the cardboard and byproducts can be baled separately and/or shipped either on truck or rail car to paper, metal and plastic manufacturers and recyclers throughout the country.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A method for forming a layered bale of compressed recyclable waste, comprising:

forming a first compressed outer layer of cardboard using a baler by positioning a plurality of individual pieces of cardboard within the baler and compressing the cardboard within the baler, and such that the first compressed outer layer of cardboard is formed from several individual pieces of cardboard, the first outer layer of cardboard having a generally uniform thickness;

subsequent to forming the first compressed outer layer of cardboard, forming a plurality of compressed recyclable waste layers and a plurality of compressed intermediate cardboard layers on top of the first compressed outer layer of cardboard using the baler by positioning a plurality of recyclable waste layers and a plurality of intermediate cardboard layers within the baler and compressing the plurality of recyclable waste layers and the plurality of intermediate cardboard layers within the baler, wherein recyclable waste layers of the plurality of compressed recyclable waste layers and intermediate cardboard layers of the plurality of compressed intermediate cardboard layers alternate such that each major planar surface of each of the intermediate cardboard layers is substantially covered by a corresponding one of the recyclable waste layers, wherein each of the recyclable waste layers of the plurality of compressed recyclable waste layers visibly extends an entire length of said bale, from a first end of said bale to an opposing second end of said bale, as well as an entire width of said bale, from a first side of said bale to an opposing second side of said bale, each of the plurality of compressed recyclable waste layers comprising a plurality of recyclable waste material and each of the plurality of compressed intermediate cardboard layers comprising a plurality of individual pieces of cardboard;

forming a second compressed outer layer of cardboard over the plurality of compressed recyclable waste layers and the plurality of compressed intermediate cardboard layers using the baler by positioning additional cardboard within the baler and compressing the additional cardboard within the baler, the second compressed outer layer of cardboard having a generally uniform thickness; and binding together the first compressed outer layer of cardboard, the plurality of compressed recyclable waste layers, the plurality of compressed intermediate cardboard layers, and the second compressed outer layer of cardboard to form a compressed composite bale formed of cardboard and recyclable waste products, wherein each of the plurality of compressed recyclable waste layers is composed of recyclable waste that excludes cardboard and which is composed of material from the group consisting of plastic bags, plastic film, aluminum cans, plastic bottles and/or plastic clothing hangers, and wherein the plurality of compressed recyclable waste layers includes bonding agents comprising at least some plastic film or plastic bags which help maintain integrity of the layered bale, the bonding agents being operable to bond different portions of the recyclable waste material together which may become rigid or not conform to an adjacent portion of the recyclable waste material and which are optionally included within the plurality of waste layers.

2. A method as recited in claim 1, wherein one or more of the recyclable waste layers of the plurality of recyclable waste layers comprises a plurality of types of recyclable waste products, the plurality of types of recyclable waste products comprises at least two of a group consisting of: aluminum beverage cans, plastic bottles, plastic clothing hangers, plastic film, used plastic bags, and shredded paper.

3. A method as recited in claim 1, wherein one or more of the recyclable waste layers of the plurality of recyclable waste layers comprises a plurality of types of recyclable waste products, the plurality of types of recyclable waste products comprises at least one of a first group consisting of used plastic bags and plastic film, and further comprises at least one of a second group consisting of aluminum cans, plastic bottles, plastic clothing hangers, and shredded paper.

4. A method as recited in claim 3, wherein forming the one or more recyclable waster layers comprises sandwiching recyclable waste selected from the second group between the recyclable waste selected from the first group.

5. A method as recited in claim 1, wherein forming each of the first compressed outer layer of cardboard, the plurality of compressed recyclable waste layers, the plurality of compressed intermediate cardboard layers, and the second compressed outer layer of cardboard using the baler comprises performing a plurality of compression cycles.

6. A method as recited in claim 5, wherein each compression cycle of the plurality of compression cycles compresses additional cardboard or recyclable waste such that said bale is formed by repeatedly loading and activating the cardboard baler.

7. A method as recited in claim 1, wherein the plurality of recyclable waste layers comprises from about 10% to about 70% of the bale thickness.

8. A method as recited in claim 1, wherein the first compressed outer layer of cardboard, the plurality of compressed intermediate cardboard layers, and the second compressed outer layer of cardboard have a sufficient thickness such that a plurality of said bales can be stacked on one another, with the planar surfaces of layers of cardboard and recyclable waste positioned perpendicular to gravity, without said bales losing structural integrity.

9. A method as recited in claim 1, wherein said bale is bound together with wire, rope, or straps.

10. The method as recited in claim 1, wherein the plurality of recyclable waste layers comprise a first intermediate layer composed of only plastic film and at least one other intermediate layer composed of a material other than plastic film.

11. The method as recited in claim 10, wherein the at least one other intermediate layer is composed of plastic bottles.

12. The method as recited in claim 10, wherein the at least one other intermediate layer is composed of paper.

13. The method recited in claim 10, wherein the at least one other intermediate layer includes a second intermediate layer composed of plastic bottles and a third intermediate layer composed of paper.

* * * * *